United States Patent [19]

Suzuki

[11] Patent Number: 4,887,503

[45] Date of Patent: Dec. 19, 1989

[54] AUTOMATIC ACCOMPANIMENT APPARATUS FOR ELECTRONIC MUSICAL INSTRUMENT

[75] Inventor: Satoshi Suzuki, Hamamatsu, Japan

[73] Assignee: Yamaha Corporation, Hamamatsu, Japan

[21] Appl. No.: 211,433

[22] Filed: Jun. 24, 1988

[30] Foreign Application Priority Data

Jun. 26, 1987 [JP] Japan ..... 62-158919

[51] Int. Cl.[4] ..... G10H 1/06; G10H 1/36; G10H 7/00

[52] U.S. Cl. ..... 84/613; 84/615; 84/653

[58] Field of Search ..... 84/1.03, 1.19, 1.28

[56] References Cited

U.S. PATENT DOCUMENTS 4,358,980 11/1982 Imamura ..... 84/1.19
4,538,495 9/1985 Sato ..... 84/1.19
4,624,170 11/1986 Ohno et al. ..... 84/1.19 X
4,699,039 10/1987 Oguri et al. ..... 84/1.03

*Primary Examiner*—Stanley J. Witkowski

*Attorney, Agent, or Firm*—Spensley Horn Jubas & Lubitz

[57] ABSTRACT

An automatic accompaniment apparatus for an electronic musical instrument is provided with an instrumentation selecting switch for selecting a desired instrumentation, a data generator for generating instrumentation data selected by the selecting switch when the selecting switch is depressed, and an accompaniment tone generator for generating an accompaniment tone signal in accordance with one of the number of tones corresponding to the number of musical instruments and a tone color corresponding to a tone color name of each musical instrument set in response to the instrumentation data derived from the data generator. Thus, when the desired instrumentation is selected by the selecting switch, the automatic accompaniment apparatus generates automatically the accompaniment tone signal with the number of tones and/or tone colors corresponding to the contents of the selected instrumentation. Further, the automatic accompaniment apparatus can also generate an accompaniment tone signal, for every instrumentation, with an accompaniment pattern suitable for the instrumentation.

4 Claims, 7 Drawing Sheets

| TONE COLOR NAME | TONE COLOR NO. |
|---|---|
| PIANO | 1 |
| CLARINET | 2 |
| TROMBONE | 3 |
| BANJO | 4 |
| JAZZGUITAR | 5 |
| SAX | 6 |
| CONTRABASS | 7 |
| NON | 0 |

FIG. 2

AUTOMATIC ACCOMPANIMENT APPARATUS FOR ELECTRONIC MUSICAL INSTRUMENT

BACKGROUND OF THE INVENTION (a) Field of the Invention

The present invention relates to an automatic accompaniment apparatus for an electronic musical instrument automatically generating chord tones, bass tones and the like.

Description of the Prior Art

In the past, a typical automatic accompaniment apparatus for an electronic musical instrument has been known which is designed so that accompaniment patterns corresponding to plural chord types (or chord groups) are previously stored in a memory in accordance with the type of rhythm such as march, waltz, etc. and, when a specific rhythm type is selected, a signal for an accompaniment tone such as a chord tone is generated automatically in accordance with an accompaniment pattern corresponding to a chord type (for example, C major) designated by a keyboard or the like among accompaniment patterns related to the rhythm type (refer to, for example, Japanese Patent Laid-Open No. Sho 61-292692).

According to the prior art mentioned above, an image of a tone such as minor, major, etc. can be derived from the performance of music, while on the other hand, it has not been easy to bring about an accompaniment effect reflecting the degree of the scale of an instrumentation (which is a formation of musical instruments used in a musical performance) during the playing of a melody or different melodies. In other words, although such an accompaniment effect can be achieved to some extent by determining whether each accompaniment part (for example, bass part) is used or not, through panel operation, and alternatively by making the selection of an accompaniment tone color or a variation pattern, it has not been sufficient to imitate such an accompaniment tone as derived from a desired instrumentation. Further, it is not easy to set properly various manipulators on the panel and it has been very difficult in particular for a beginner to carry out such operation during the performance.

SUMMARY OF THE INVENTION

An object of the present invention is to provide an automatic accompaniment apparatus for an electronic musical instrument in which an accompaniment effect reflecting the degree of the scale of an instrumentation is brought about through simple operation.

Another object of the present invention is to provide an automatic accompaniment apparatus for an electronic musical instrument in which more numerous expressions of an image 10 of a music piece are made and even a beginner can lightly enjoy playing an automatic accompaniment imitating an accompaniment tone derived from the instrumentation.

The automatic accompaniment apparatus for an electronic musical instrument according to the present invention is provided with a selector, a data generator and an accompaniment tone generator. The selector is adapted to select an arbitrary instrumentation from among a plurality of instrumentations. The data generator is adapted to generate instrumentation data representative of at least one of the number of musical instruments and a tone color name of each musical instrument in the instrumentation selected by the selector. Also, the accompaniment tone generator is adapted to set at least one of the number of simultaneously producible tones corresponding to the number of musical instruments and a tone color corresponding to a tone color name of each musical instrument in accordance with the instrumentation data derived from the data generator and to generate an accompaniment tone signal on the basis of the setting contents.

According to the formation of the present invention, when an arbitrary instrumentation is selected by the selector, an accompaniment tone signal can be produced with the number of tones and/or a tone color corresponding to the contents of the instrumentation. Therefore, the same accompaniment effect as in a desired instrumentation can easily be brought about without any troublesome operation of various manipulators.

According to a preferred formation of the present invention, designs may be made so that, when a group of accompaniment patterns are previously stored in a memory or the like with respect to each instrumentation and then an arbitrary instrumentation is selected, plural series of accompaniment tone signals are generated in accordance with a group of accompaniment patterns corresponding thereto. If the electronic musical instrument is constructed in such a manner, advantages are secured that an accompaniment tone can be produced with the accompaniment pattern suitable for each instrumentation and it is facilitated to bring about characteristics for the substance of the accompaniment of each instrumentation.

These and other objects as well as the features and the advantages of the present invention will become apparent from the following detailed description of the preferred embodiment when taken in conjunction with the accompanying drawings.

BRIEF DESCRIPTION OF THE DRAWINGS

FIG. 2 is a view showing tone color numbers of respective tone color names;

DESCRIPTION OF THE PREFERRED EMBODIMENT

Figure 1:
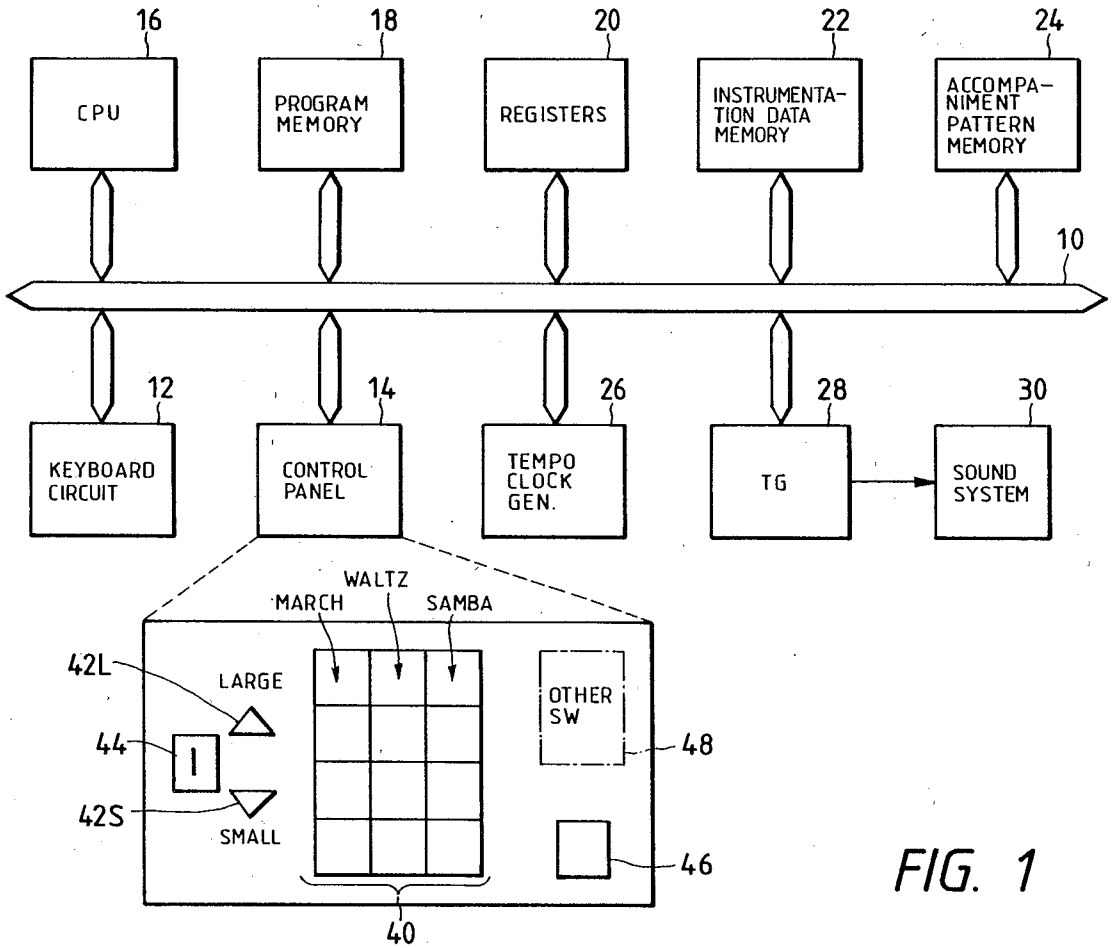
FIG. 1 is a block diagram showing a structure of an electronic musical instrument provided with an automatic accompaniment apparatus according to the present invention.

FIG. 1 shows a structure of an electronic musical instrument according to an embodiment of the present invention, which is designed so that the generation of various musical tones such as manual performance tones, automatic rhythm tones, automatic chord tones, automatic bass tones and the like is controlled by a microcomputer.

Structure of Electronic Musical Instrument (FIG. 1)

To a bus 10 are connected a keyboard circuit 12, a control panel 14, a central processing unit (CPU) 16, a program memory 18, groups of registers 20, an instrumentation data memory 22, an accompaniment pattern memory 24, a tempo clock generator 26, a tone generator (TG) 28, and the like.

The keyboard circuit 12 is composed of a keyboard for melody playing (for example, upper keyboard), a keyboard for accompaniment playing (for example, lower keyboard), etc. and is configured so that key operating data are detected for each key of individual keyboards.

The control panel 14 is such that indicators as well as various manipulators for musical tone and performance control are arranged in association with appropriate manipulators, and is provided, as manipulators and indicators related to the working of the present invention, with rhythm selecting switches 40 corresponding to rhythm names such as march, waltz, samba and the like, an instrumentation selecting switch 42L for selecting an instrumentation of a larger scale, an instrumentation selecting switch 42S for selecting an instrumentation of a smaller scale, an instrumentation number indicator 44 for indicating an instrumentation number (any one of 0, 1 or 2) corresponding to the selected instrumentation, a start/stop 46 for controlling the start/stop of an automatic rhythm performance, and a switch 48 such as a tempo setting switch.

The CPU 16 is to execute various processes for the generation of musical tones in accordance with the program stored in the program memory 18, and these processes will be described later, referring to FIGS. 6 and 7.

The registers 20 include registers utilized in various processes by the CPU 16 and are composed, as registers related to the working of the present invention, of the following components described in items (1)~(7):

(1) Run flag RUN

This is a register for one bit, in which bit 1 represents the run of rhythm playing and bit 0 stands for the stop.

(2) Clock counter CLK

This is a counter in which whenever a tempo clock pulse is generated from the tempo clock generator 26, the count value is increased by one. It takes count values ranging from "0" to "31" within one bar and is reset to "0" at the timing of reaching "32".

(3) Rhythm number register RNO

This is such that a rhythm number corresponding to a rhythm name selected by any one of the rhythm selecting switches 40 is set. Also, the rhythm number is predetermined as 0, 1, 2, . . . corresponding to, for example, march, waltz, samba, . . . respectively.

(4) Instrumentation number register GNO

This is such that a value (instrumentation number) is increased or decreased by one in the range of "0" to "2" in accordance with the operation of the instrumentation selecting switch 42L or 42S. The instrumentation numbers 0, 1 and 2 correspond to the instrumentations of small, moderate and large scales, respectively.

(5) Tone color number registers $TNO_{0\sim5}$

These are registers provided with six storage areas corresponding to Nos. 0~5 tone-producing channels in an accompaniment tone source section of the TG 28, in which tone color numbers for six channels read out of the instrumentation data memory 22 are set.

(6) Chord register CHORD

This is a register in which chord data (representative of root notes and chord types) detected on the basis of key depression on the keyboard for accompaniment are stored.

(7) Key code register KCREG

This is such that key code data (note pitch data) read out of the accompaniment pattern memory 24 are stored.

The instrumentation data memory 22 is adapted to store instrumentation data corresponding to three types of instrumentations of large, moderate and small scales for each rhythm name. Each of instrumentation data is representative of the number of musical instruments and a tone color name for each musical instrument in the corresponding instrumentation and specifically, the data are prepared in such a manner that tone color numbers predetermined for individual tone color names are provided for six channels as shown in FIG. 2.

Figure 3:
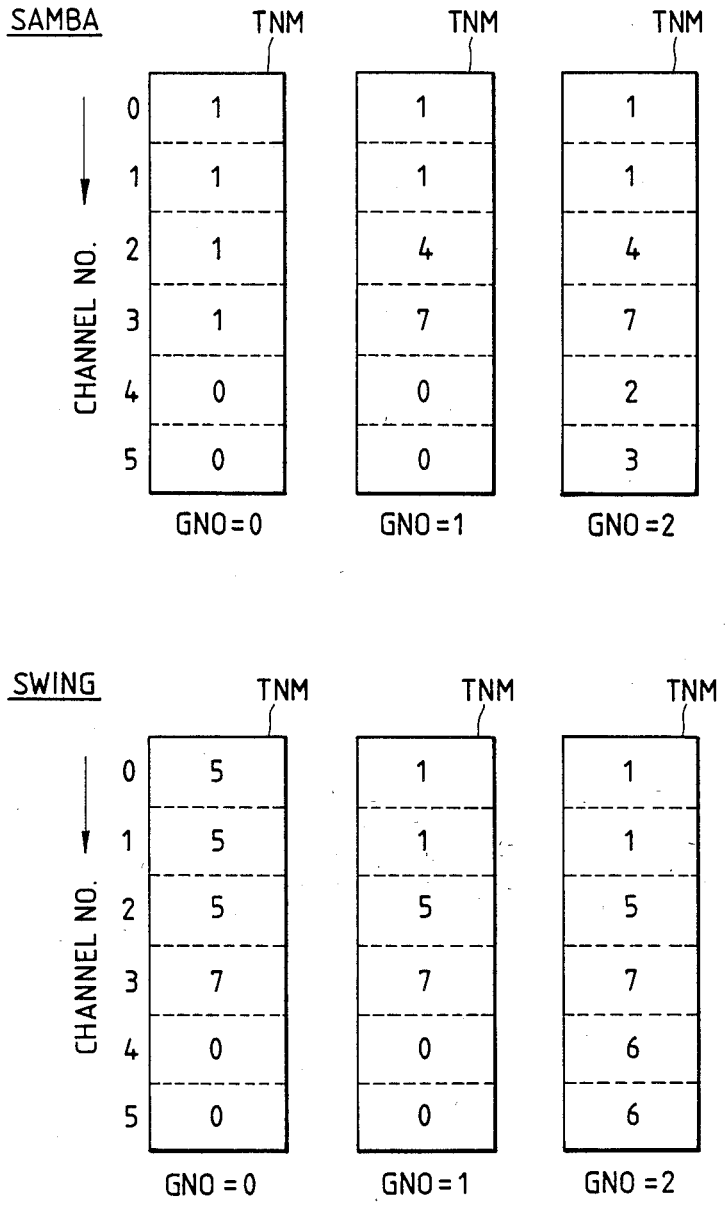
FIG. 3 is a view showing storage examples in an instrumentation data memory.

FIG. 3 depicts storage examples of the memory 22 with respect to rhythm names "samba" and "swing". Three tone color number storage sections TNM corresponding to the instrumentation number GNO=0~2 are provided for each rhythm name, and each of the tone color number storage sections TNM is provided with six storage areas corresponding to channel numbers 0~5.

With respect to "samba" as an example, tone color numbers 1, 1, 1, 1, 0, 0 are arranged, corresponding to channel numbers 0~5, respectively, in the storage section TNM corresponding to the instrumentation number GNO=0. According to such a tone color number arrangement, it is instructed that Nos. 0~3 tone-producing channels are caused to be tone-produced with the tone color of a piano and Nos. 4 and 5 tone-producing channels are placed in a state of non-pronunciation.

Figure 4:
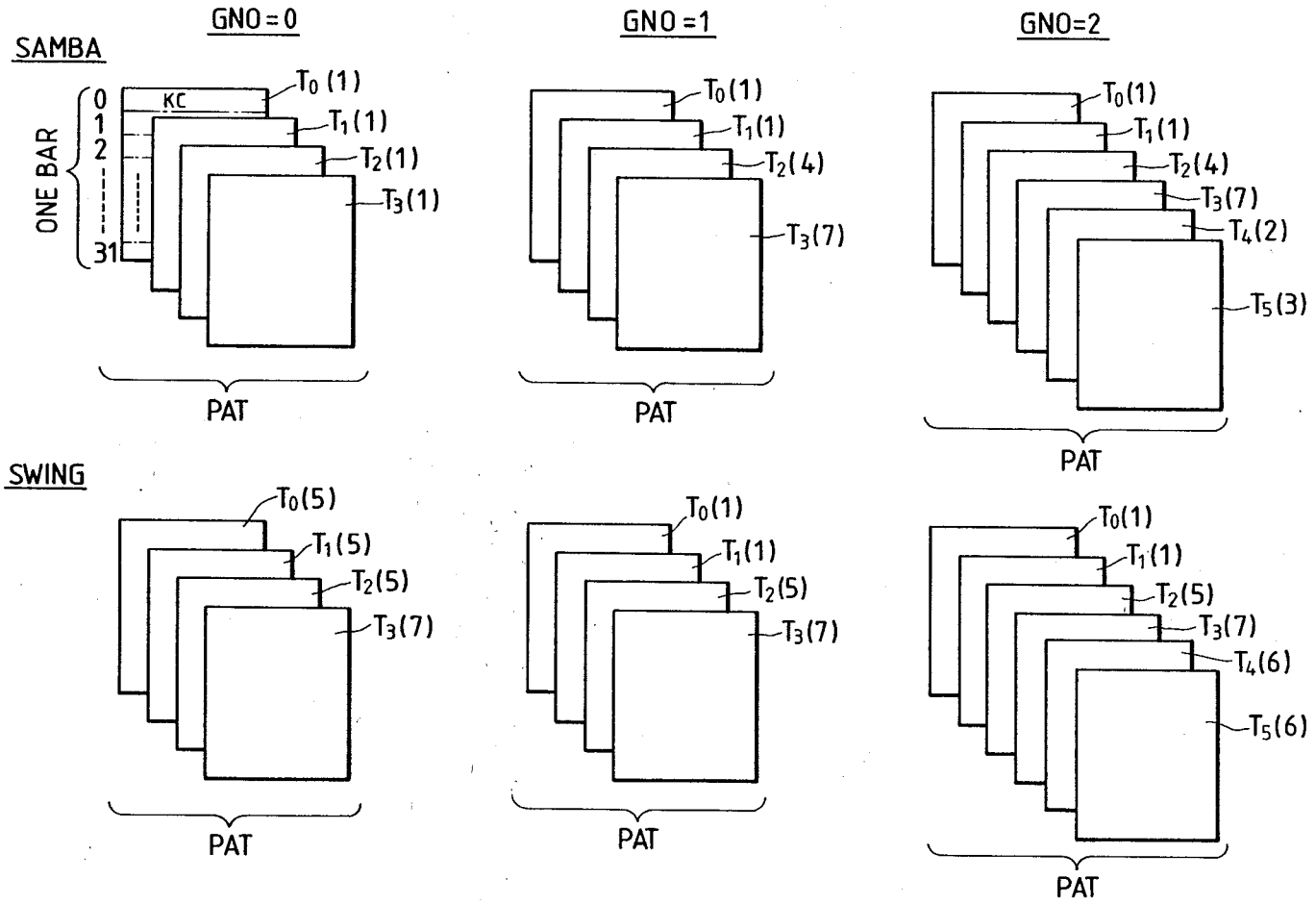
FIG. 4 is a view showing storage examples in an accompaniment pattern memory.

The accompaniment pattern memory 24 is to store three groups of accompaniment patterns corresponding to three types of instrumentations of large, moderate and small scales for each rhythm name, and its storage examples are shown in FIG. 4 with regard to rhythm names "samba" and "swing". Specifically, pattern storage sections PAT corresponding u to the instrumentation numbers GNO=0~2 are provided for each rhythm name, and groups of Nos. 0~2 accompaniment patterns are stored in individual sections.

Each of the groups of accompaniment patterns is constituted by accompaniment patterns with numbers corresponding to the number of musical instruments in a related instrumentation. In No. 0 accompaniment pattern group of the rhythm name "samba", for instance, four accompaniment patterns $T_0\sim T_3$ corresponding to Nos. 0~3 tone-producing channels are included and all of these patterns $T_0\sim T_3$ are adapted to give a performance with the tone color of a piano as seen from the tone color numbers indicated in parentheses of FIG. 4.

As illustrated by the example of an accompaniment pattern $T_0$ in No. 0 accompaniment pattern group of "samba", each accompaniment pattern is such that each of key code data KC is arranged in accordance with addressing represented by the count values 0~31 for one bar of the clock counter CLK described above. Although each of key code data KC represents a tone pitch according to its value, a value 0 indicates non-pronunciation.

Figure 5:
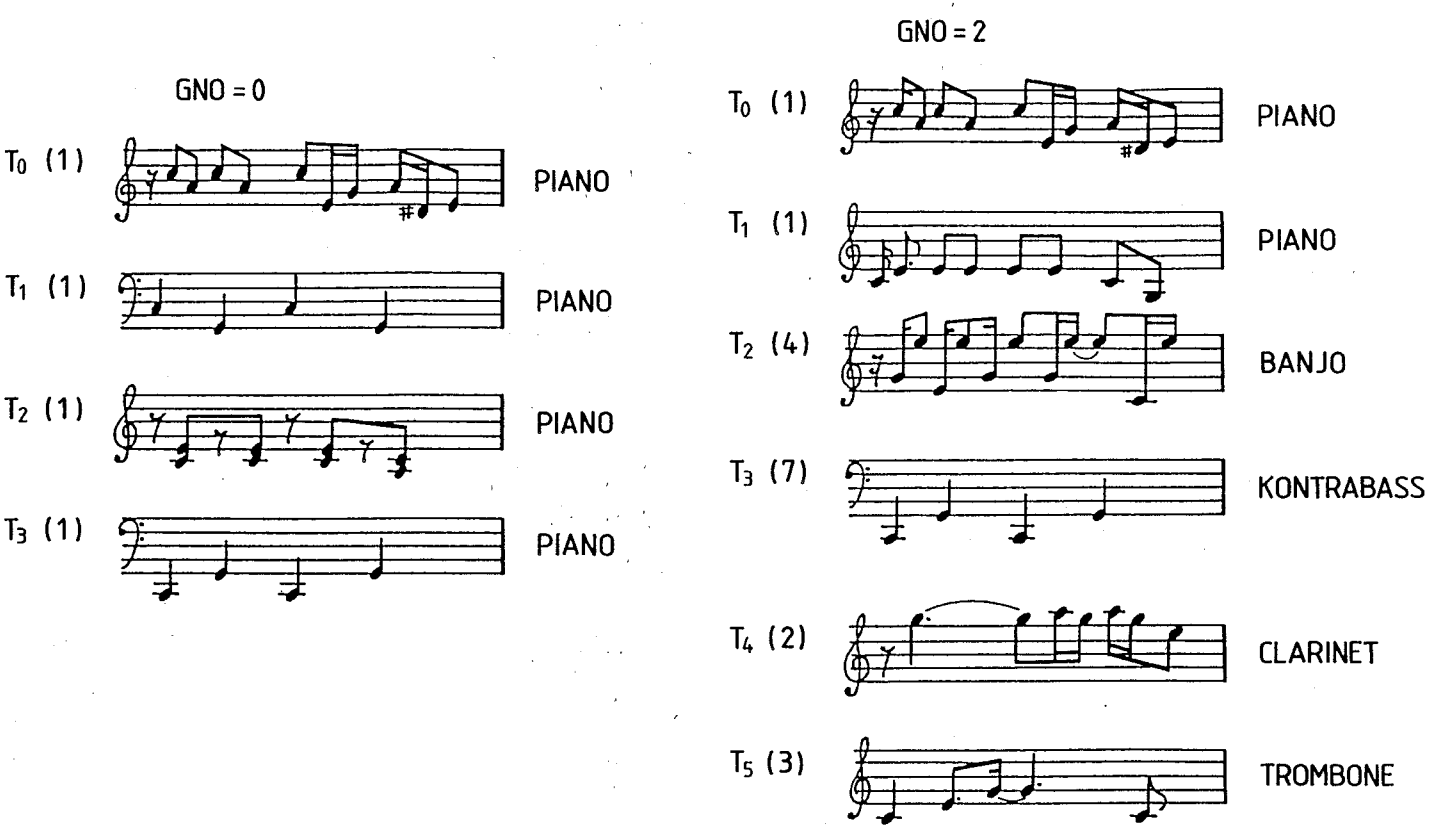
FIG. 5 is a view of musical staffs showing examples of performance contents of No. 0 and No. 2 accompaniment pattern groups of "samba"

FIG. 5 illustrates performance contents of accompaniment patterns $T_0 \sim T_5$, in the form of musical staffs, with respect to the groups of Nos. 0 and 2 accompaniment patterns of "samba" shown in FIG. 4. Here, the numbers indicated in parentheses of the patterns $T_0 \sim T_5$ are representative of tone color numbers.

Figure 7:
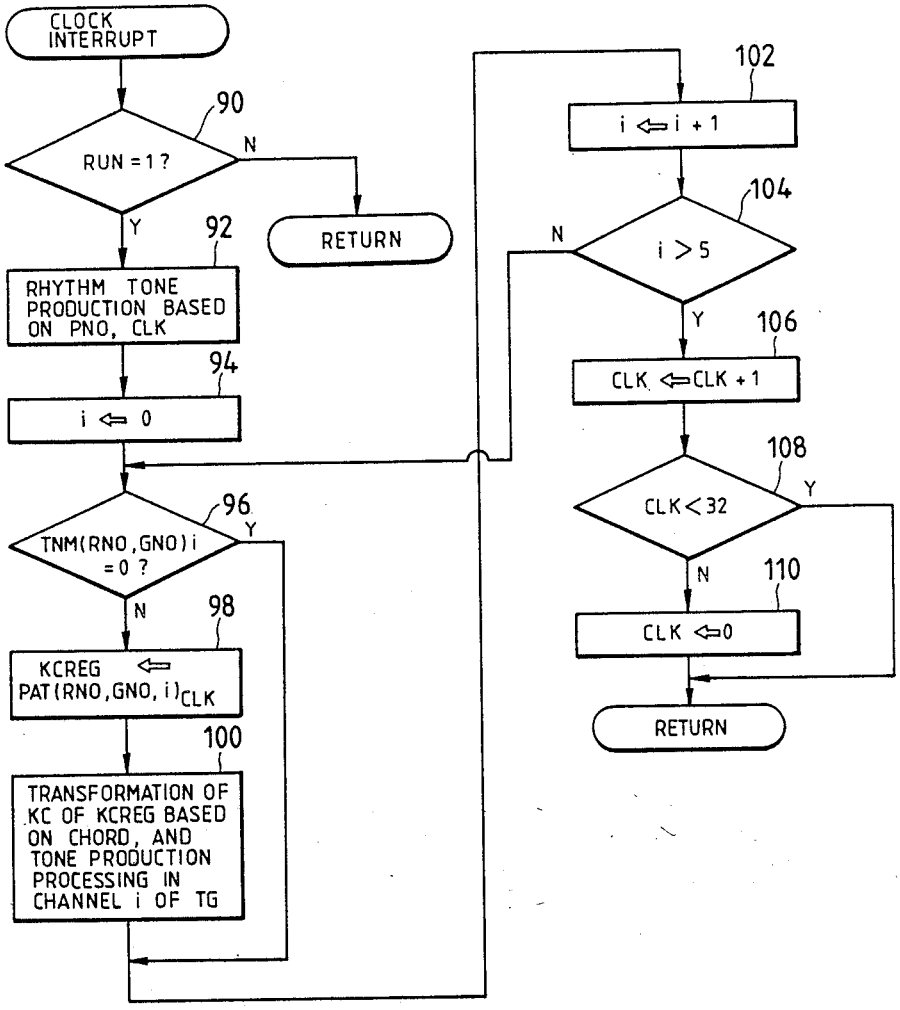
FIG. 7 is a flow chart showing clock interruption routine.

The tempo clock generator 26 is to generate tempo clock pulses on the basis of the tempo which has already been set, and each of the tempo clock pulses is utilized as an interruption instructing signal for starting clock interruption routine shown in FIG. 7.

The TG 28 includes a melody tone source section, an accompaniment tone source section, a rhythm tone source section, etc. and it is as mentioned above that the accompaniment tone source section related to the working of the present invention has Nos. 0~5 tone production channels. In the accompaniment tone source section, the number of channels (the number of simultaneously producible tone) to be used in the automatic accompaniment and the tone color for each channel in use are determined in accordance with the contents of the tone color number register $TNO_{0\sim5}$ mentioned above.

A musical tone signal delivered from each tone source section of the TG 28 is supplied to a sound system 30 and is converted into an audible sound.

Figure 6:
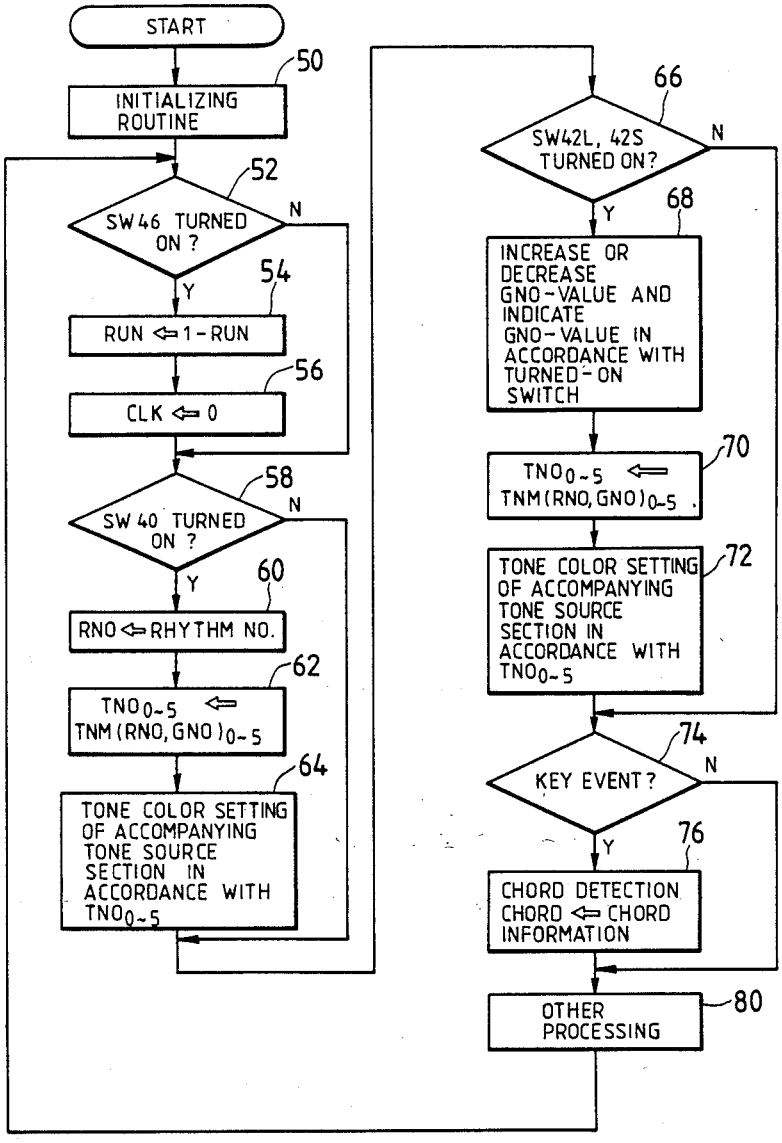
FIG. 6 is a flow chart showing main routine.

Main routine (FIG. 6)

FIG. 6 shows the flow of processing of main routine, which is started in accordance with the turn-on of a power supply.

First of all, in Step 50, initializing routine is executed to initially set various registers. For example, any of the register RNO, the counter CLK, and the flag RUN is set to "0" and the register GNO is set to "1" (corresponding to the instrumentation of a moderate scale). Further, the value of the register GNO is caused to be indicated on the indicator 44.

Next, in Step 52, judgment is given as to whether the start/stop switch 46 is turned on. When the result of this judgment is affirmative, (Y), the processing shifts to Step 54 so that the value of 1 - RUN is set to the flag RUN. As a result, if the value of the flag RUN is still "0", it turns to "1" (the run of rhythm playing), while if the value has already been "1", it turns to "0" (the stop of rhythm playing). After this, the processing moves to Step 56 and the counter CLK is set to "0".

When the processing in Step 56 is completed, or when the result of the judgment in Step 52 is negative, (N), the processing advances to Step 58 so that judgment is made as to which of the rhythm selecting switches 40 is turned on. If the result of this judgment is affirmative, (Y), the processing moves to Step 60, in which the rhythm number corresponding to the rhythm selecting switch which has been turned on is entered into the register RNO. Then, the processing moves to Step 62.

In Step 62, data TNM (RNO and GNO)$_{0\sim5}$ for the six channels of the tone color number storage section TNM specified in accordance with values of the registers RNO and GNO are read out from the memory 22 to be entered into the registers $TNO_{0\sim5}$.For example, if RNO=2 (samba) and GNO=1 (moderate scale), the tone color numbers (instrumentation data) "114700" for the six channels related to "samba" shown in FIG. 3 are read out from the memory 22 to be set into the registers $TNO_{0\sim5}$. The processing then advances to Step 64.

In Step 64, a tone color setting processing of the accompaniment tone source section of the TG 28 is executed in accordance with the contents of the registers $TNO_{0\sim5}$. Specifically, the tone color numbers for the six channels of the registers $TNO_{0\sim5}$ are supplied, as tone color designating data, to Nos. 0~5 tone-producing channels of the accompaniment tone source section. Hence, in the case where the contents of the registers $TNO_{0\sim5}$ exhibit "114700" as in the above instance, it follows that Nos. 0, 1, 2 and 3 tone-producing channels are set to the tone colors of "piano", "banjo" and "contrabass", respectively.

When the procedure of Step 64 is over, or when the result of the judgment in Step 58 is negative, (N), the processing advances to Step 66 to judge whether the instrumentation selecting switch 42L or 42S is turned on. If the result of this judgment is affirmative, (Y), the processing moves to Step 68 and the value of the register GNO is increased or decreased by one in compliance with the switch 42L or 42S which has been turned on. As an example, if the switch 42L is turned on for the first time after the register GNO is initially set to "1" in Step 50 as stated above, the value of the register GNO changes from "1" to "2". Thus, the register GNO can be set at an arbitrary value among the numbers 0, 1 and 2. Further, Step 68 causes the value of the register GNO to be indicated on the indicator 44.

After the completion of Step 68, the processing moves to Step 70, in which the tone color numbers for the six channels are read out from the memory 22, in the same manner as the processing in Step 62 mentioned above, to be entered into the registers $TNO_{0\sim5}$. This is the processing necessitated with the procedure that the value of the register GNO has been changed in Step 68. For instance, if the value of the RNO is 2 (samba) and the value of the register GNO is changed from "1" (moderate value) to "2" (large scale), the tone color numbers "114723" for the six channels are set in the registers $TNO_{0\sim5}$. After then, the processing shifts to Step 72.

In Step 72, like the case of Step 64, the tone color setting processing of the accompaniment tone source section of the TG 28 is performed in accordance with the contents of the registers $TNO_{0\sim5}$. As a result, if the contents of the registers $TNO_{0\sim5}$ exhibit "114723" as in the preceding example, it follows that Nos. 0, 1, 2, 3, 4 and 5 tone-producing channels are set to the tone color of "piano", "piano", "banjo", "contrabass", "clarinet" and "trombone", respectively.

When the processing in Step 72 is completed, or when the result of the judgment in Step 66 is negative, (N), the processing moves to Step 74 to judge whether there is a key event (key-on or key-off) on the keyboard for accompaniment. If the result of this judgment is affirmative, (Y), the processing moves to Step 76 so that the root note and the type of a chord tone (such as major, minor and seventh) are 10 detected on the basis of a state of key depression on the keyboard for accompaniment and chord data corresponding to the detected result are entered into the register CHORD.

When the processing in Step 76 is finished, or when the result of the judgment in Step 74 is negative, (N), the processing shifts to Step 80 and other processing is carried out therein. As the other processing, there is a tempo setting processing, for instance.

Following Step 80, the processing returns to Step 52 and such procedures as described above are repeated.

Clock Interruption Routine (FIG. 7)

FIG. 7 depicts the flow of processing of clock interruption routine, which is started whenever a tempo clock pulse is generated from the tempo clock generator 26.

To begin with, in Step 90, judgment is made as to whether the value of the register RUN is "1" and, if the value does not indicate "1", that is, the result of this judgment is negative, (N), the processing returns to the routine of FIG. 6.

In contrast to this, if the result of the judgment in Step 90 is affirmative, (Y), the processing advances to Step 92, in which a rhythm tone generation processing is executed. That is, from among a large number of rhythm patterns stored, corresponding to rhythm names such as march, waltz, samba . . . etc., in a rhythm pattern memory (not shown), a rhythm pattern corresponding to the rhythm number 10 of the register RNO is selected and, if a rhythm tone to be produced with the timing corresponding to the value of the clock counter CLK is included in the rhythm pattern, it is generated by the operation of the rhythm tone source section.

Next, after a control variable i corresponding to the channel number is set to "0" in Step 94, the processing moves to Step 96, in which judgment is made as to whether "i" of data TNM (RNO and GNO)$_i$ corresponding to No. i tone producing channel is "0" (that is, whether the tone color number is "0") in the tone color number storage sections TNM specified in accordance with the value of the registers RNO and GNO. If the result of this judgment is negative, (N), the processing moves to Step 98 so that, in the pattern storage section PAT specified in accordance with the values of the registers RNO and GNO and the variable i, data PAT (RNO, GNO and i)$_{CLK}$ of address corresponding to the value of the clock counter CLK are read out from the memory 24 to be entered into the register KCREG. In such a case, the data actually entered into the register KCREG are such key code data KC as shown in FIG. 4. The processing then moves to Step 100.

In Step 100, the key code data KC of the register KCREG are transformed into tone pitches, as necessary, based on the chord data of the register CHORD and, in accordance with the key code thus obtained, a tone-producing processing is carried out with No. i tone-producing channel in the accompaniment tone source section of the TG 28. It follows from this that an accompaniment tone to be produced with the timing corresponding to the value of the clock counter CLK is sounded out, if any.

When the procedure of Step 100 is completed, or when the result of the judgment in Step 96 is affirmative, (Y) (that is, the tone color number is "0"), the processing moves to Step 102, in which the value of "i" is raised up by one. Then, the procedure of Step 104 is followed.

Step 104 is to judge whether the value of "i" is more than "5". When the processing reaches to Step 104 for the first time after the setting of i=0 is performed in Step 94, the result of the judgment in Step 104 becomes negative, (N) because of i=1 and the processing returns to Step 96. Then, until i>5 (completion of processing for the six channels) is obtained, the procedures following Step 96 are repeated. As a result, when, for example, RNO=2 (samba) and GNO=2 (large scale), it becomes possible to sound out simultaneously the accompaniment tones of six channels in accordance with the patterns $T_{0\sim5}$ in No. 2 accompaniment pattern group of "samba" shown in FIG. 3. Further, when GNO=0 in this example, it becomes possible to sound out simultaneously the accompaniment tones for four channels.

When i>5, the result of the judgment in Step 104 becomes affirmative, (Y), and the processing moves to Step 106.

In Step 106, the value of the clock counter CLK is increased by one. Then, the procedure of Step 108 is followed to judge whether the value of the clock counter CLK is less than "32" (that is, exists within one bar). If the result of this judgment is affirmative, (Y), the processing returns to the routine of FIG. 6, while on the other hand, if negative, (N), the value of the counter CLK is set to "0" in Step 110 before the processing returns to the routine of FIG. 6.

After the value of the counter CLK is set to "0" in Step 110, the performance returns to the top (the beginning of the bar) of the accompaniment pattern and the patterns are read out. Consequently, the automatic accompaniment is achieved in such a manner that the accompaniment patterns for one bar are repetitively performed. Further, an automatic rhythm performance is also achieved with such an automatic accompaniment.

MODIFIED EMBODIMENT

The present invention is not limited to the embodiments described above and allows the following modifications to be made, for example.

(1) Although the above embodiments are constructed so that both the number of the musical instruments (the number of tone productions) and the tone color name of each musical instrument (the tone color name of sound) are set independently for each instrumentation (instrumentation numbers 0~2), they may also be designed so that the number of musical instruments (or the tone color name of each musical instrument) is common with respect to each instrumentation and only the tone color name of each musical instrument (or the number of musical instruments) is set for each instrumentation.

(2) Human voices and the like may be included in the instrumentation to be imitated. That is, such "musical instruments" as in "the number of musical instruments" and "the tone color name of each musical instrument" stated in the specification of the present invention are not representative of only ordinary musical instruments shown exemplarily in FIG. 2, but include tones of, for example, human voices (man's and woman's voices), in addition to the ordinary musical instruments.

What is claimed is:

1. An automatic accompaniment apparatus for an electronic musical instrument, comprising:

selecting means for selecting an arbitrary instrumentation from among a plurality of predetermined instrumentations, wherein at least one of the predetermined instrumentations identifies a number of simultaneously producible tones and each of said number of simultaneously producible tones has an associated tone color so that at least said one of the predetermined instrumentations identifies a plurality of musical instruments;

data generating means for generating data representative of each musical instrument in an instrumentation selected by said selecting means and a tone color name of each musical instrument in said instrumentation selected by said selecting means; and accompaniment tone generating means for setting at least one of the number of simultaneously producible tones corresponding to said number of musical instruments and a tone color corresponding to said tone color name of each musical instrument in accordance with the data derived from said data generating means and for generating an accompaniment tone signal in accordance with its setting contents.

2. An automatic accompaniment apparatus as in claim 1 wherein said selecting means is a switch.

3. An automatic accompaniment apparatus for an electronic musical instrument, comprising:

selecting means for selecting an arbitrary instrumentation from among a plurality of predetermined instrumentations, wherein at least one of the predetermined instrumentations identifies a number of simultaneously producible tones and each of said number of simultaneously producible tones has an associated tone color so that at least said one of the predetermined instrumentations identifies a plurality of musical instruments;

first memory means storing a plurality of groups of tone color data corresponding to said plurality of instrumentations so that each of said groups of tone color data is representative of a plurality of tone color names corresponding to individual musical instruments in a related instrumentation;

read-out means reading out a group of tone color data corresponding to an instrumentation selected by said selecting means from said first memory means;

second memory means storing a plurality of groups of accompaniment patterns corresponding to said plurality of instrumentations so that each of said groups of accompaniment patterns is composed of accompaniment patterns with numbers corresponding to the number of musical instruments in a related instrumentation; and accompaniment tone generating means for setting a plurality of tone colors corresponding to a plurality of tone color names in accordance with and indicated by a group of tone color data read out from said first memory and for reading out a group of accompaniment patterns corresponding to the instrumentation selected by said selecting means from said second memory means to thereby generate a plurality of series of accompaniment tone signals having individually said plurality of tone colors in accordance with said group of accompaniment patterns.

4. An automatic accompaniment apparatus as in claim 3 wherein said selecting means is a switch.

* * * * *